US007534948B2

(12) United States Patent
Rice

(10) Patent No.: US 7,534,948 B2
(45) Date of Patent: May 19, 2009

(54) METHOD AND APPARATUS FOR A DEVICE TO CREATE A MUSICAL NOISE

(76) Inventor: Steven H. Rice, 3331 Bay Rd., Ferndale, WA (US) 98248

( * ) Notice: Subject to any disclaimer, the term of this patent is extended or adjusted under 35 U.S.C. 154(b) by 0 days.

(21) Appl. No.: 09/814,581

(22) Filed: Mar. 21, 2001

(65) Prior Publication Data

US 2001/0047715 A1 Dec. 6, 2001

Related U.S. Application Data

(60) Provisional application No. 60/191,005, filed on Mar. 21, 2000.

(51) Int. Cl.
*G10D 13/08* (2006.01)

(52) U.S. Cl. ..... 84/404; 84/403; 84/422.3

(58) Field of Classification Search ..... 84/402, 84/403, 422.3, 422.2, 422.1, 418
See application file for complete search history.

(56) References Cited

U.S. PATENT DOCUMENTS 2,466,554 A 4/1949 Mossey
2,658,421 A 11/1953 Clayton
2,785,596 A 3/1957 Korosh
3,994,197 A * 11/1976 Bills ..... 84/418
4,911,056 A * 3/1990 Belli et al. ..... 84/402
5,138,535 A 8/1992 Aragon, Jr.
5,323,678 A * 6/1994 Yould ..... 84/418

* cited by examiner

*Primary Examiner*—Shih-Yung Hsieh
(74) *Attorney, Agent, or Firm*—Michael F. Hughes; Hughes Law Firm, PLLC

(57) ABSTRACT

A musical instrument that having a shaker that is adapted to house a plurality of impact particles. The instrument employs a spring mass system where the mean mass of the impact particles provide a force due to the accelerations as the impact the lower portion of the inner surface of the shaker member. Where the force of impact of the impact particles causes a compression of a shaker spring which provides an opposite force upon the impact particles while the spring is expanding and hence raises the mean mass of the impact particles away from the lower portion of the inner surface of the shaker. Thereby, the impact particles repeat the cycle of falling upon the lower surface and a damping oscillation motion is created. Where the impacts of the impact particles causes a desirable musical sound.

31 Claims, 5 Drawing Sheets

METHOD AND APPARATUS FOR A DEVICE TO CREATE A MUSICAL NOISE

RELATED APPLICATIONS

This application claims priority of U.S. Provisional Application(s) 60/191,005 filed on Mar. 21, 2000.

BACKGROUND OF THE INVENTION

The present invention relates to a musical instrument and more particularly to a musical percussion instrument that incorporates a form of a "shaker".

BACKGROUND ART

A brief description of the background art is as follows

U.S. Pat. No. 5,138,535 (Aragon) shows a baby rattle which has a light transparent shell, and when the rattle is moved back and forth, the impact causes the lights to go on. The only relevance of this is that it does show a center mounting member 44 which thus would make the chamber of the rattle have an annular configuration.

U.S. Pat. No. 2,466,554 (Mossey) shows a pair of conventional sticks 10 for use by a drummer, and on each stick there is formed a hollow ball that would have particulate material inside. Thus, as the drummer moves the stick against the drum, the motion also creates the maraca effect in rhythm to the movements of the drumsticks. Again, this relevant only in that it would automatically show something of an annular configuration of the shaker.

The following two patents show foot operated devices that shake maracas back and forth.

U.S. Pat. No. 2,785,596 shows a foot peddle operating device where there are two maracas mounted about a pivot location 28 for back and forth motion opposite to one another. Each of these maracas are connected to the peddle through a link 46 so that as the peddle moves down, both maracas rotate. There is a spring 56 that is connected to one of the maraca handles, and it appears that the main effect of this spring 52 is to pull on the handle in such a way that it raises the foot peddle to its up position. It does not appear that it would cause any continuing oscillating movement of the maracas 38 and 40.

The second patent relating to the foot peddle operated concept is U.S. Pat. No. 2,658,421. The peddle 12 acts through a rod 28 to move the pivotal member 20 back and forth. The pivot member 20 causes the impact of the beaters 32 and 36 against the base drum. In addition, there is a vertical rod 50 that is attached at a lower end to a spring 58 and at its upper to a cross bar 56 that is in turn connected to two maracas 46. The handles of the maracas are each attached to a related spring arm 44. Thus, when the peddle 12 is depressed, this lowers the spring 52 which would pull the rod 50 downwardly.

SUMMARY OF THE INVENTION

An apparatus to create musical noise. The apparatus has a first member that has a longitudinal axis where the first member is adapted to travel in a substantially reciprocating motion along the said longitudinal axis. The range of travel of the first member is defined as a first range or range of motion. The first member comprises a first stop location where a first portion of a shaker spring is operatively engaged thereto. The shaker spring further comprises a second portion located at the opposite region of the shaker spring. The first member further comprises a second stop location. The apparatus further has a shaker having an inner surface defining a cavity that is adapted to house a plurality of impact particles or beads. The shaker is adapted to move into direction the longitudinal axis and at least a portion of the shaker is adapted to move between the second stop location and the second portion of the shaker spring.

BRIEF DESCRIPTIONS OF THE DRAWINGS

DESCRIPTION OF THE PREFERRED EMBODIMENT

Figure 1:
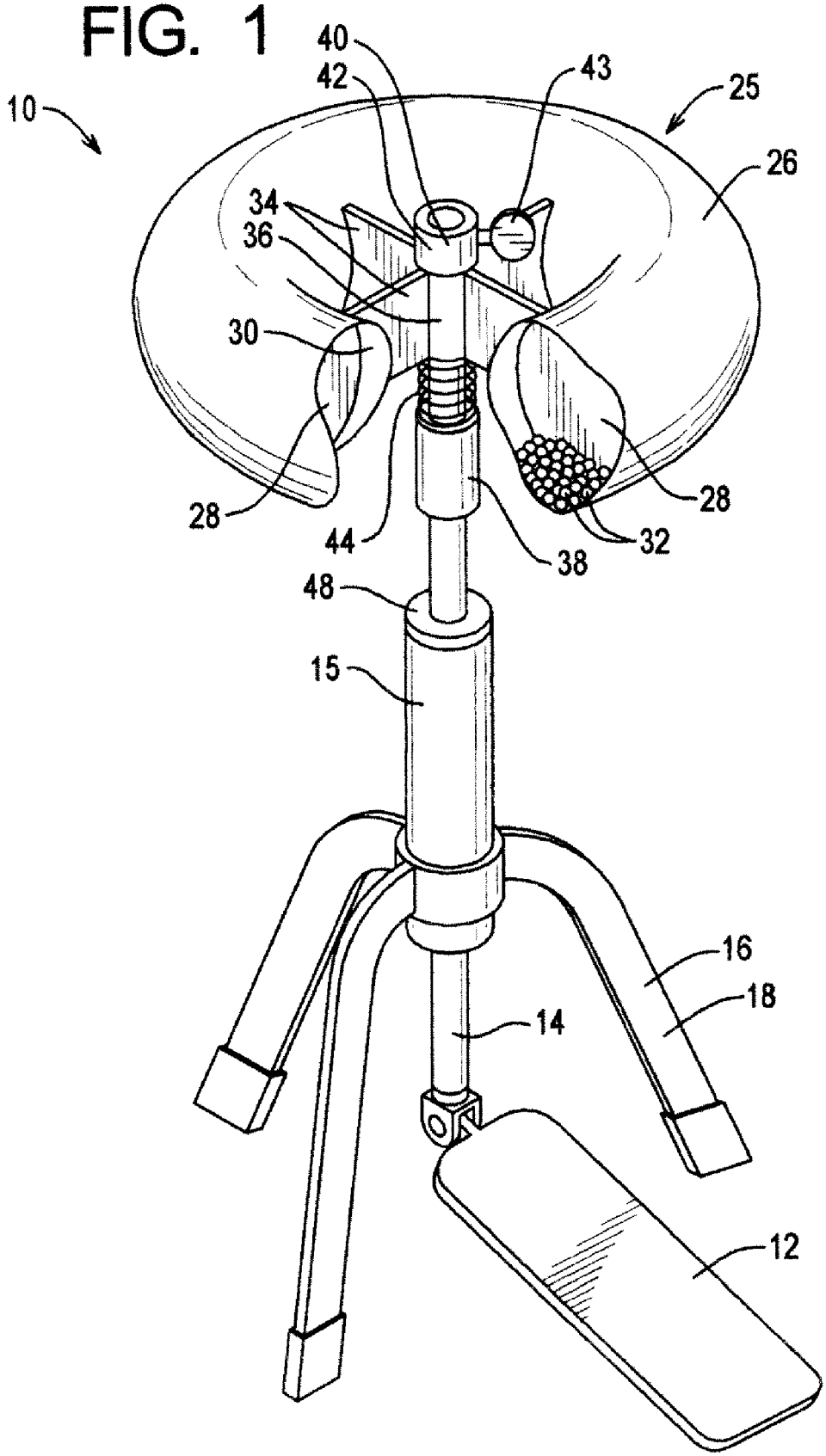
FIG. 1 is an isometric view illustrating the apparatus of the present invention.

The apparatus 10 of a first embodiment of the present invention is shown in FIGS. 1-4, and it comprises a foot pedal 12, the outer swing end of which is attached to a vertical rod 14 that is formed as upper and lower rod sections 14*a* and 14*b*, respectively. This rod 14 extends upwardly through a stationary sleeve or frame member 15 which is in turn supported from the floor or other stationary structure by a tripod 16. This tripod 16 is shown in a rather simplified form comprising three legs 18 which extend outwardly to provide a stable support. It is to be understood that in a commercial model, the would be provided with the appropriate braces and the entire tripod assembly would be made so that it is collapsible so that it could be stowed. For ease of illustration the tripod 16 is not shown in FIGS. 2, 3 and 4.

Figure 2:
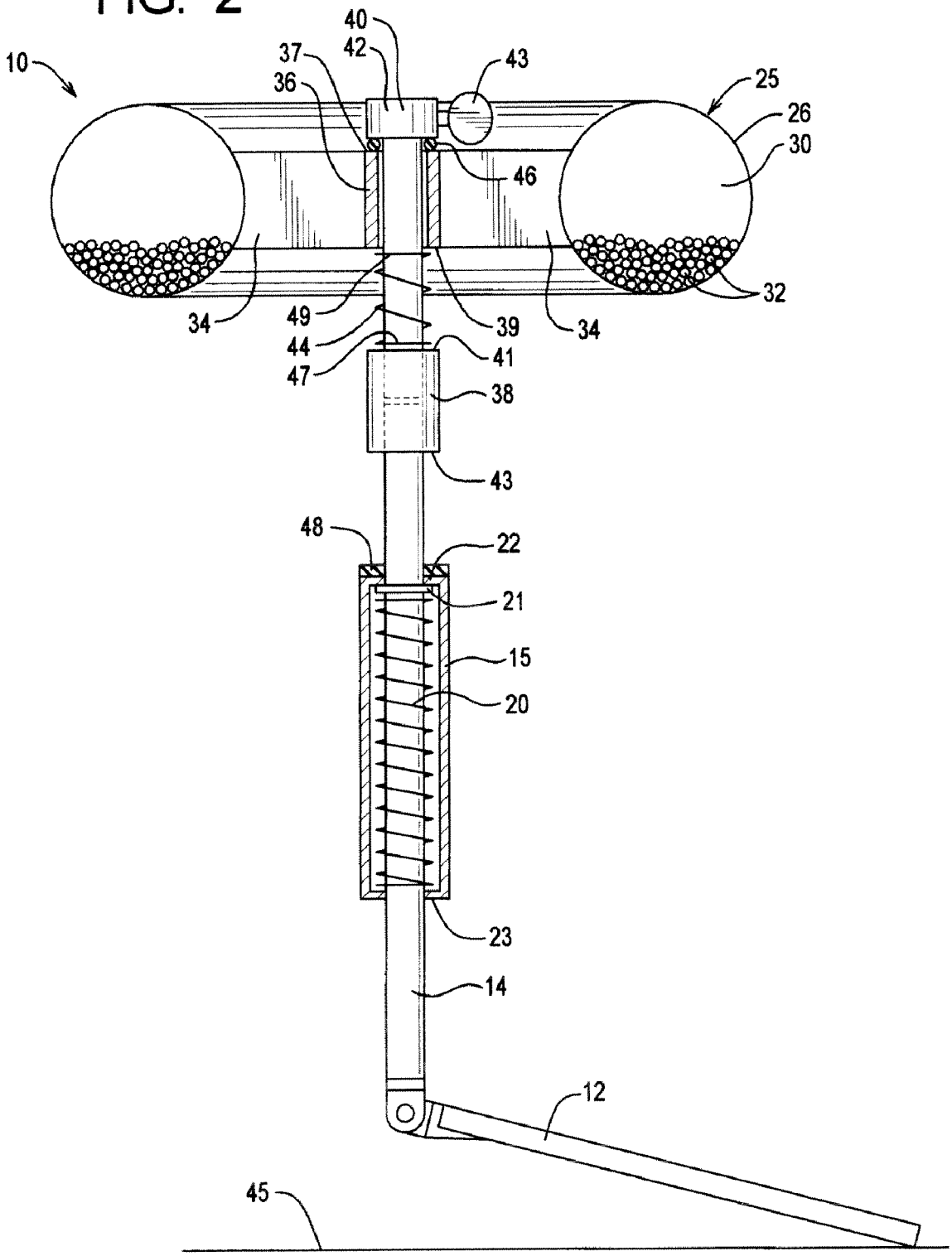
FIG. 2 is a side elevational view, with some of the components being in section, and also showing the apparatus in its rest position.
Figure 3:
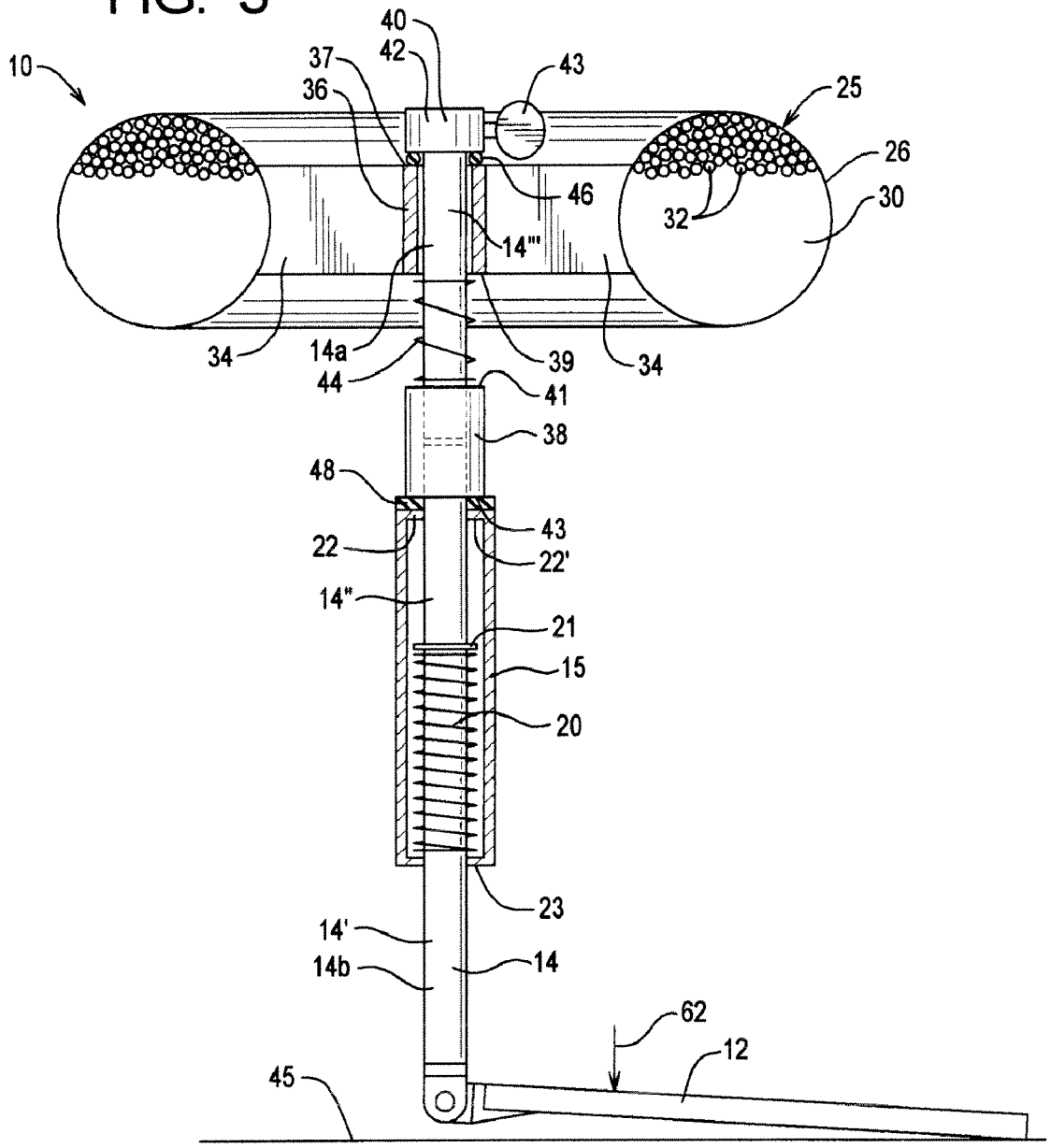
FIG. 3 shows the same apparatus as a view similar to FIG. 2, but showing the apparatus in action, where the foot pedal has just been depressed to its down position.
Figure 4:
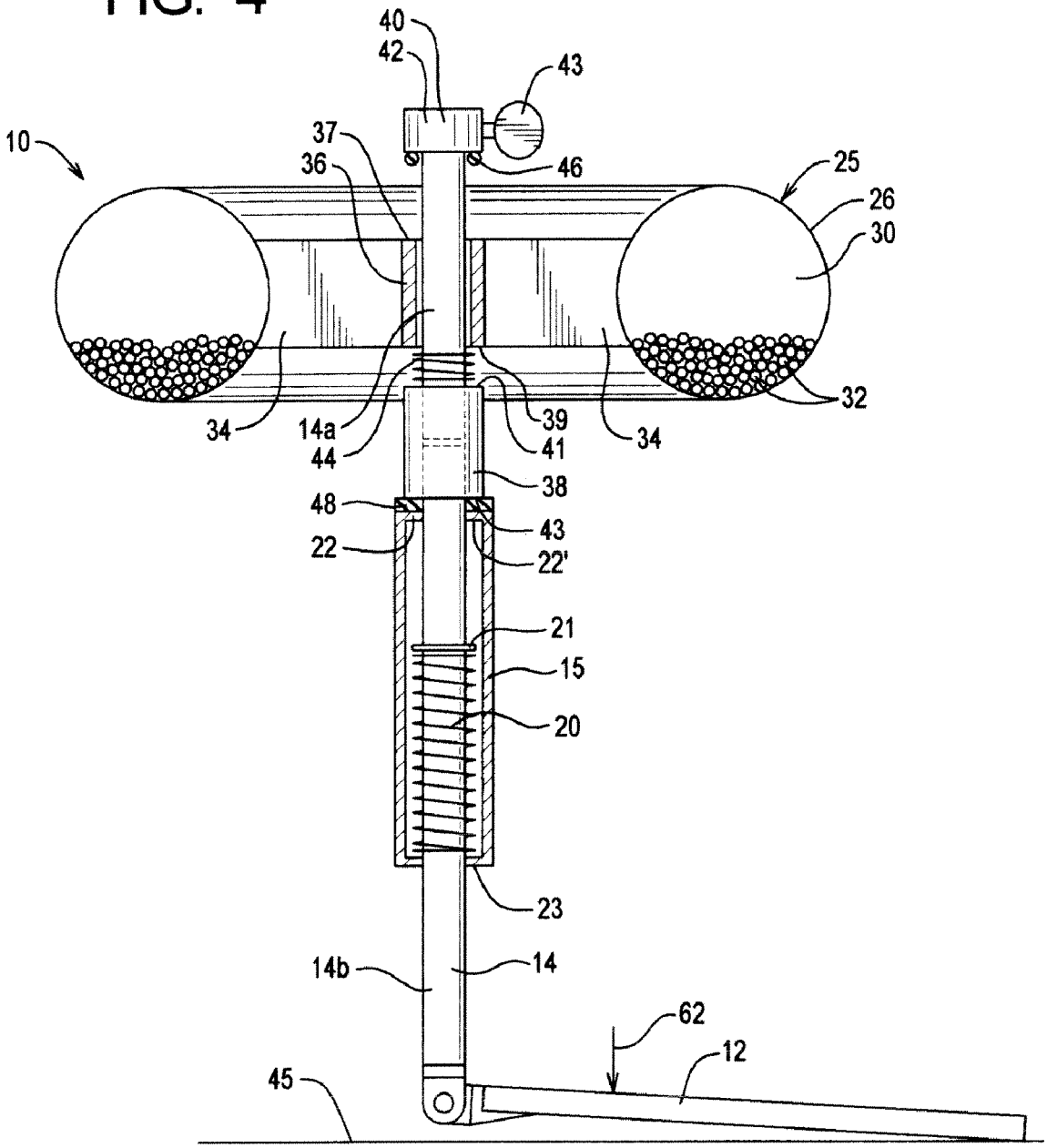
FIG. 4 is a view similar to FIGS. 2 and 3, but showing the apparatus after a very short increment of time is passed and the "high shaker" of the apparatus has moved downwardly against its compression spring to start at the initiation of a back and forth motion.

As shown in FIGS. 2, 3 and 4 there is a coil spring 20 positioned within the sleeve 15. This spring 20 presses against an upper stop member 21 that is fixedly attached to the rod 14 and in its upper position engages an annular inwardly extending upper flange 22 defining a second support surface 22' to limit its upward travel. The lower end of the spring (or first spring) 20 bears against a lower annular inwardly extending flange 23 that provides a first base support surface formed at the bottom end of the sleeve 15. The components 12-23 described above are, or may be, conventional, and these same components 12-23 are commonly used in a prior art percussion instrument called a "high hat".

To disclose now the novel portions of the present invention, there is a novel form of the shaker 25 which comprises a donut-shaped container 26 (i.e. torus shaped) the interior of which is separated by radially aligned interior walls or surface 28 defining a central cavity which are transversely aligned with respect to the circumference of the torus shaped container 26. These walls 28 are located at 90 degrees spaced locations to make four separate 90 degree compartments 30 each having an arcuate length of 90 degrees. In each compartment there is a number of beads or impact particles 32. The purpose of the partitions 28 is to maintain an equal quantity of beads 32 in each of the four quadrants 30 so that the donut-shaped container 26 is balanced. There are four radial spokes 34 joined at their outer ends to the container 26 and at their inner ends to a central hub (or central base portion) 36 which is mounted around the upper part 14*a* of the rod 14 for up and down reciprocating motion. The central hub 36 further has an upper surface 37 and a lower surface 39 whereas the upper surface adapted to engage the lower surface of the upper stop member 40 and the lower surface 39 is adapted to be functionally engaged to the shaker spring 44. The shaker spring 44 comprises a first portion 47 and a second portion 49 that are located at opposite functional regions of the spring. The first portion 47 is functionally attached to the drive rod 14 at the upper surface 41 of the nut 38. The term functionally attached means that this is the area of the control rod where the spring applies pressure thereto and can for example the rigidly attached thereto or slidably located on the rod 14 imparting a force onto surface 41. Further, a number of springs can be employed for the preferred embodiment in the broader scope of the present invention.

FIGS. 1-4 further show a lower cylindrically shaped connecting nut member 38 that is engaged by inner threads to the top end of the lower section 14*b* of the rod (or referred to as the drive rod or first member) 14 and also inner threads to engage the lower end of the shorter upper rod section 14*a* in the preferred form. The top end of the upper rod section 14*a* is connected to stop member (or upper stop member) 40 in the form of collar 42 held in place by a thumb screw 43. The drive rod 14 further has a lower portion 14', a central portion 14" and an upper portion 14"' (see FIG. 3). The nut member 38 has an upper surface 41 and a lower surface 43. The drive rod 14 has a central longitudinal axis that extends the length of the rod. Further, the direction indicated by arrow 62 defines a first direction. Likewise, the direction substantially diametrically opposed to arrow 62 is referred to as a second direction.

There is a coil spring (or otherwise referred to as the second spring, or shaker spring) 44 which surrounds the lower part of the upper part of the rod portion 14*a*. The lower end of this compression spring 44 bears against the connecting nut member 38, and the upper part of the compression spring 44 bears against the hub 36 of the high shaker 25. Thus the nut member 38 functions both as a connector and as a stop member for the lower end of the spring 44. Positioned around the upper rod section 14*a* is a resilient O-ring 46 defining a lower stop surface adapted to engage the surface 41 of the nut member 38. The O-ring 46 is positioned at the lower surface of the stop member 40. This O-ring 46 serves as a resilient cushion to engage the hub 36 at the end of its upper limit of travel. The bottom surface of the O-ring 46 defines a second stop location on the first member 14 (or rod 14). In the preferred form the stop member and O-ring 46 are employed. However, the broader scope any method to restrict the range of travel of the shaker 25 can be employed. For example, a flexible member can be attached to the shaker 25 and the other portion of the flexible member could be attached to a stationary frame member. Alternatively, a form of a stop member 40 can be employed to restrict the travel of the shaker 25, and a second member attached to the shaker 25 can be used to displacing the shaker 25 along the longitudinal axis of the rod 14. In this broader scope of the invention, the rod 14 could be stationary during operation.

Further, there is an annular bumper 48 made of rubber or some other resilient material at the top end of the sleeve 15 to cushion the impact of downward travel of the rod 14 when it reaches its lower limit.

To describe the operation of this first embodiment, reference is made to FIGS. 2, 3 and 4. FIG. 2 shows the apparatus 10 in its rest position. It can be seen that the spring 20 is holding the rod 14 in its uppermost position so that the upper surface of the stop member 21 presses against the flange 22, with the rod 14 being at its upper limit of travel and the pedal 12 being positioned above the floor level 45. Also, the compression spring 44 positions the shaker 25 at its upper location where the center hub is spaced upwardly from the connector/stop member 38 and is in contact with the upper stop member 40.

Let us assume that the musician abruptly pushes the foot pedal 12 down to its lowermost position where the pedal 12 is a short distance above the floor level 45, and the connector/stop member 38 is bottomed out against the bumper 48. With the spring 44 being in moderate compression in supporting the weight of the shaker 25 and also pressing the hub 36 with moderate force against the upper stop member 40, as shown in FIG. 2, the shaker 25 moves downwardly at the same velocity as the rod 14. When the rod 14 has abruptly bottomed out by the connector/stop member 36, at that instant the shaker 25 is in the position of FIG. 3. However, the inertia of the shaker 25 will cause it to continue its downward travel from the position shown in FIG. 3 toward the position in FIG. 4. It will also be noted that as the shaker 25 has been moved downward rather abruptly by the rapid downward travel of the stop member 40 engaging the hub 36, the inertia of the beads 32 caused them to strike the upper part of the container 26.

Then with the pedal 12 still being depressed, as the shaker 25 moves from the position of FIG. 3 to FIG. 4, it compresses the spring 44 to the position shown in FIG. 4. Also, it can be seen that the beads 32 have now either dropped to the lower position in the container 26 and have impacted the lower wall portion of the container 26 or are dropping downwardly to make such impact.

Let us now assume that the musician has kept his foot on the pedal 12 so as to leave the pedal 12 depressed for a short period of time. At this time, the spring 44 (being compressed), will push the shaker 25 upwardly to engage the stop member 40. The hub 36 of the shaker 25 in striking the upper stop member 40 will cause an abrupt stop, thus causing the beads 32 to continue to move upwardly and impact the upper portion of the container 26.

Again, assuming that the pedal 12 remains depressed, then the shaker 25 would experience some rebound action from the O-ring 46 and drop downwardly to a position somewhat above the position shown in FIG. 4, with the beads 32 again dropping downwardly. Thus the spring 44, being compressed, would move the shaker 25 back upwardly. The up and down motion of the beads acts as a damping force against the up and down motion of the spring 44, and after one or two oscillations, the up and down motion would become sufficiently short so that there would be little or no further up and down motion of the beads 32.

From the above description, it becomes apparent that simply abruptly depressing the pedal 12 will cause a vertical "shaking action" of the shaker 25 so that the beads will move up and down in the container 26. The musical effect of this is a more immediate and louder sound of the beads impacting the wall of the container 26, and then a series of "schush-like" sounds due to subsequent oscillations.

Let us now assume that these oscillations have subsided so that there is no more sound emitting action of the beads 32, and that now the pedal 12 is abruptly raised by the drummer quickly raising his foot. The immediate effect of this is that the spring 20 would act against the stop member 21 to immediately cause the rod 14 to rise. At this time, the spring 44 is holding the shaker 25 at its uppermost position of FIG. 2. Then with the abrupt rise of the connector/stop member 38, the spring 44 will again become compressed and will cause the shaker 25 to accelerate upwardly. Then when the spring 20 has been fully extended, the stop member 21 abruptly stops when it strikes the flange 22 to stop further upward motion of the rod 14. The action of the spring 44 then immediately pushes the shaker 25 upwardly so that the hub 36 of the shaker 25 hits the O-ring 46. This would result in the beads 32 continuing their upward travel to strike the upper wall of the container 26. Then the shaker would rebound in a downward direction to again compress the spring 44 and the beads 32 would drop to the lower part of the container 26. There would be a continuing (but diminishing) oscillating motion caused by the movement of the spring back and forth to again emit the "schush-like" sounds.

Now let us examine the operation of the invention where there is the downward movement of the foot pedal 12 followed in a very short increment of time by a release of the pedal 12 to permit it to move rather rapidly in an upward direction. Now we have a more complex interaction between the springs and the moving masses involved. To relate this to FIGS. 2-4, let us assume that the pedal 12 has been abruptly depressed so that the rod 14 moves from the position of FIG. 2 rather rapidly down to the position of FIG. 3. In the position of FIG. 3, we will assume that the pedal 12 has just bottomed out where the connector/stop member 38 has impacted with the bumper 48. In this position, as described above, we can expect the shaker 25 will continue its downward motion to compress the spring 44 to the position of FIG. 4.

Now let us assume that instead of keeping the pedal 12 in its down position, almost immediately after the pedal 12 is depressed, it is released to cause the spring 20 to move against the stop member 21 and move the rod 14 upwardly. We now have a situation where the spring 20 is pushing the rod 14 in an upward direction, but the spring 44 being compressed by the downward momentum of the shaker 25, is exerting a force to push the connector/stop member 38 downwardly. Let us further assume that for a short increment of time the forces exerted by the two springs 20 and 44 are about equal. In that instant, the upward movement of the rod 14 would be retarded. However, as the downward movement of the shaker decelerates, then the action of the spring 21 and the spring 44 combine to propel the shaker 25 upwardly at a greater speed and if only one of the springs 20 and 44 were acting alone. The effect of this would be further oscillations of the shaker 25 in its upper position such as shown in FIG. 2.

However, to add another possibility in the operation of the present invention, let us assume that the same method of operation has been initiated as described above, and we are now at the time period where the spring 21 is moving toward its full up position of FIG. 2, and the spring 44 is pushing the shaker 25 to its furthest up position. However, before the shaker 25 has been able to move to its full position, the pedal 12 is again abruptly depressed causing the upper stop member 40 to engage the hub 36 at the time that the shaker 25 is on an upward path of travel. This would cause a more abrupt deceleration of the upward movement of the shaker 25 and a greater impact of the beads against the upper portion of the wall of the container 26.

Thus, it can be seen that the musician can time the depressing of the pedal 12 its release, and again depressing it in timed relationship to the oscillating motion caused by the spring 44 to reinforce, diminish or vary the oscillating motion of the shaker 25.

At this point, to provide a better appreciation of the operating aspects of the present invention and how other methods of using could be employed, it may be helpful to review some basic principals concerning a spring mass system and apply this to the present invention. Let us take the rather simple example where there is an object (e.g. a one pound weight) which is attached to one end of a coil spring, and the person has the other end of the coil spring in his hand. This spring mass system has a resonant frequency which depends upon the strength of the string and the mass of the object attached to the spring.

To explain this further, let us assume that the person moves his hand up and down slowly so that the frequency of the up and down motion is below this resonant frequency. When this happens, the weight will generally follow the motion of the person's hand, with a certain amount of lag. As the hand is moved up slowly, the spring will extend to a certain extent, but in large part the object will simply follow the person's hand. Now as the person moves his hand downwardly, the object again will descend, and when the person's hand stops, the object will also decelerate and then maybe make a few oscillations a short distance up and down.

Now let us assume that the person moves his hand up and down more rapidly. When the up and down motion of the person's hand reaches the resonant frequency, then the pattern of motion changes so that as a person's hand is moving down the object is moving up, and as a person's hand is moving up, the object is moving down. At the resonant frequency, if there is very little frictional resistance, as the up and down motion of the hand continues, the amplitude of the object moving up and down will become greater and greater. Also, as the up and down movement of the person's hand increases, thus applying more energy into the spring mass system, if the losses are very low the amplitude of the up and down movement of the object will increase more rapidly. However, because there are always some losses involved, such as frictional losses, then the oscillations will decline unless the imparted energy to the system by the person moving his hand up and down matches the energy losses. Now let us relate this analysis to the present invention.

If the beads 32 were simply glued in place so that these would not move in the container 26 with the up and down motion of the shaker 25, and if the frictional engagement of the hub 36 around the upper part of the rod 14 were very low, then if there is an oscillating motion imposed on the shaker 25, the oscillation will continue for a longer time. But the up and down movement of the loose beads 32 in the container 26 creates increased losses, thus causing the oscillations to diminish more rapidly.

Now we superimpose the up and down motion of the pedal 12. If the pedal 12 is moved up and down at a frequency which is at least as high as a resonant frequency of the spring mass system of the shaker 25 of the spring 44, the musician could find that as he was moving his pedal 12 up and down the shaker 25 would oscillate back and forth "in phase" with the movement of the pedal 12 which would operate in the same way as the person's hand moving the spring in the above example. In terms of a resonant mass system, this would mean that as the pedal 12 is moved up, the shaker 25 would be moving down, and as the pedal 12 is depressed, the shaker 25 would be moved upwardly.

However, let's now superimpose on this that the fact that the beads are now caused to be loose, so they have a dampening effect with less oscillations. Let us now further assume that the pedal 12 is moved up and down at a frequency which is at least higher or greater than the resonant frequency of the spring mass system of the shaker 25 and the spring 44. In this instance, provided the amplitude of the up and down movement of the pedal is great enough, the energy imparted into the spring mass system of the shaker 25 of the spring 44 would be great enough to overcome the frictional losses of the beads 32 moving up and down in the container 26 to maintain a constant oscillating action of the shaker 25 (with the upward and downward impact of the beads 32). The above analysis would also depend upon the strength of the spring 20, (i.e. if the strength of this spring 20 were sufficiently great so that the release of the pedal 12 would cause the rod 14 to rise as rapidly as the person's foot in releasing the pedal 12).

Now let us explore one more facet of the present invention and we will go back to the example of the person having an object suspended from a coil spring and the person's hand is grasping the other end of the spring. Let us now assume that the person is holding the upper end of the spring at a level three in a half feet above the ground, and the person abruptly raises his hand one foot up so as to extend the spring. The spring stretches, and then when the person stops his hand, the spring is still stretched to cause the object to accelerate upwardly. Then when equilibrium is reached where the force of the spring on the object equals the weight of this object, the upward velocity of this mass will begin to decrease as the object travels upwardly to a point where the object will stop, and then the mass will start to fall. Then we will have a series of up and down oscillations which are diminishing in amplitude. However, let us assume that at intervals of say every 5 seconds, the person again moves his hand abruptly either upwardly or downwardly. If the person times this movement correctly, then this movement will cause the oscillations to increase.

Let us now assume that this object, instead of being simply a solid mass, is the shaker 25 attached to the end of the coil. As the free end of the spring is pulled up abruptly, the shaker will start its up and down motion, with the oscillations diminishing more rapidly because of the energy losses caused by the motion of the beads. However, again if the person times his upward and downward movements relative to the up and down movement of the shaker 25, the oscillations can periodically be reinforced. Thus, when the person executes a very abrupt movement to reinforce the oscillations, the "schush-like" sound of the shaker will increase, diminish, and then increase again when there is further timed movement of the person's hand either upwardly or downwardly.

The combination of the spring 44 and the rebounding action of the O-ring 46 approximate the action of a spring-mass system. There are some deviations from this because of the spring 44 bottoming, the abrupt stops, differences in the action of the spring 44 and the O-ring 46. However, in large parts the basic relationships apply.

It is evident from the above analysis that both the design parameters and also the precise mode of operation of the apparatus can allow the musician to get a wide variety of musical percussion sounds. For example, if the spring 44 is made with a higher strength, so as to raise the resonant frequency of the spring mass system, the oscillations of the shaker 25 can be made to occur more rapidly and also have a greater force of impact.

In the present invention, the spring 44 has been described as a compression spring which always act to urge the shaker 25 upwardly, with the O-ring 46 supplying the rebound action. A variation of this would be to have the spring act both as a compression spring and as a tension spring 44, with one end of the spring 44 being attached to the connector/stop member 38 and the other end of the spring being connected to the hub 36 of the shaker 35. In this instance, the "at rest" position of the shaker 25 would be between the stops 38 and 40, and the upward force of the spring would be in that particular position would be equal to the weight of the shaker 25. However, if an up and down motion is imparted to the shaker, then the action of the spring 46 would correspond yet more closely to the "pure" mass system to cause the up and down oscillations, without the rebounding.

Figure 5:
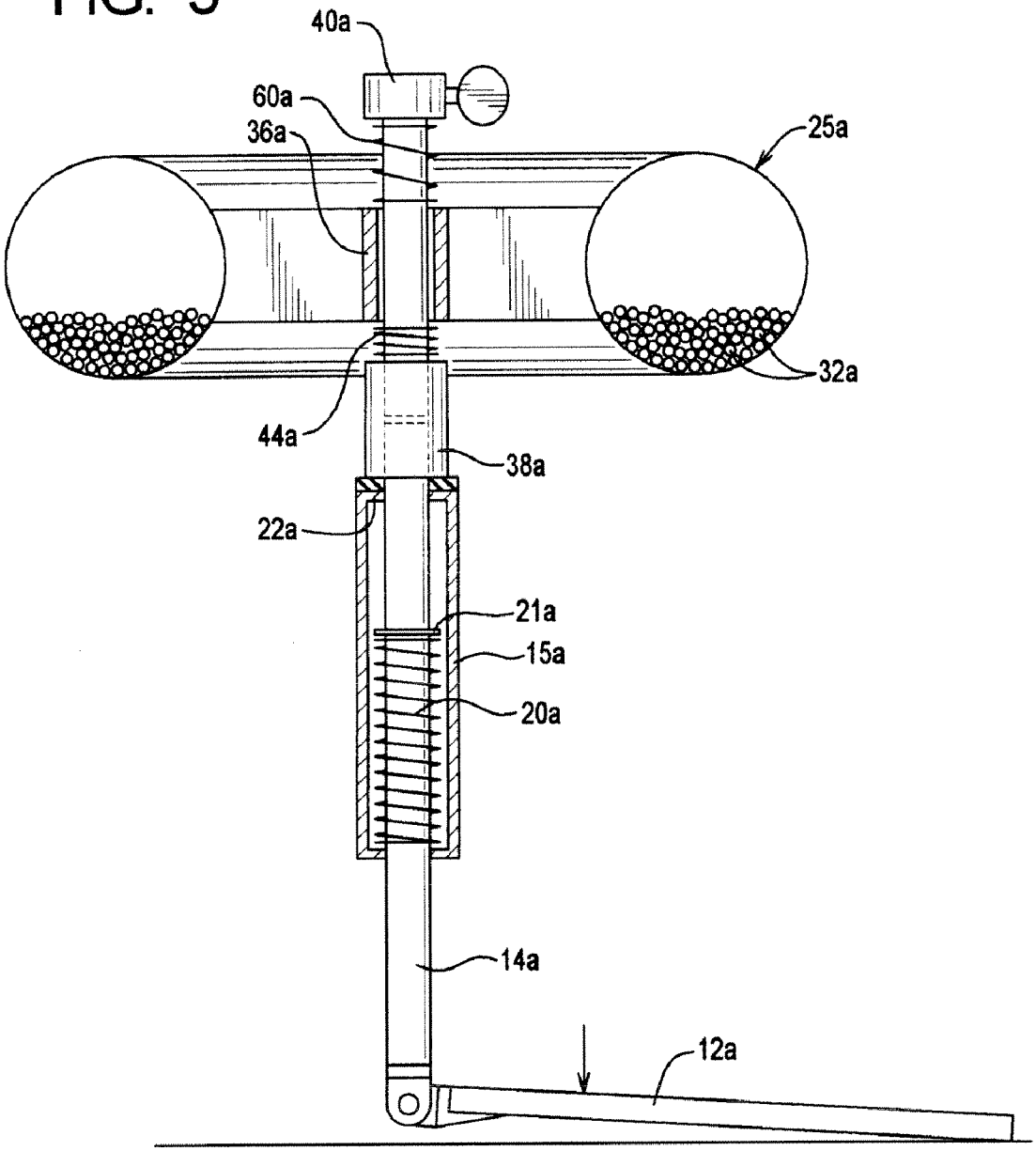
FIG. 5 is a view similar to FIG. 2 showing a second embodiment of the present invention.

Another embodiment of the present invention is shown in FIG. 5. Components of this second embodiment which are similar to components in the first embodiment will be the like numerical designations, with an "a" suffix distinguishing those of the second embodiment.

This second embodiment is substantially identical to the first embodiment, in that it has a pedal 12*a*, the rod 14*a*, the sleeve 15*a*, the spring 20*a*, the shaker 25*a*, the upper stop member 40*a*, the connector/stop member 38*a*, the hub 36*a*, etc. A difference is that there is one compression spring 44*a* positioned between the hub 36*a* and the connector/stop member 38*a*, and an additional compression spring 60*a* positioned between the upper stop member 40*a* and the hub 36*a* of the shaker 25*a*. In the position of FIG. 5, it can be seen that the pedal 12*a* is depressed to its full down position, and the shaker 25*a* is also in its further down position with the spring 44*a* being compressed, and the upper spring 60*a* being either compressed not at all, or more likely still under compression but at that location exerting a lesser force than the lower spring 44*a* which is compressed downwardly from the neutral position. Assuming that the pedal 12*a* has just now been abruptly pressed, and the shaker 25*a* has bottomed out relative to the spring 44*a*, then with the pedal 12*a* still being depressed, the shaker 25*a* will move upwardly to compress the upper spring 60*a*, then downwardly to compress the spring 44*a*, in the oscillating motion with this motion being damped by the beads 32, described above.

All of the various operating modes as described above could be employed with this second embodiment. In addition, let us explore further modes of operation. The spring mass system in the second embodiment now comprises the shaker and the two springs 44*a* and 60*a* which act together with a certain resonant frequency. Let us assume that the musician starts depressing the foot pedal up and down either continuously or periodically to match the resonant frequency. Let us assume, that the resonant frequency of this system is one complete oscillation every one third of a second, and the musician starts moving his foot up and down at a frequency of once every second with these being very abrupt downward movements which would occur when a person is keeping the beat with his foot. By timing the downward motion of the foot pedal 12 on every third oscillation of the shaker 25, the up or down motion of the shaker would be reinforced. Thus, we can envision the situation where the resulting sound on each set of three oscillations would be the first greater "schushing sound", a second somewhat lesser "schushing sound", and the third less than the second sound, with this pattern repeating.

To propose yet another mode of operation, let us assume that the musician is moving the pedal up and down a short distance at one beat every second, getting the series of sounds, and then the pedal 12 is suddenly released when the shaker 25*a* is just arriving at its lowermost position. This would cause a more rapid upward acceleration of the shaker 25*a*. This would cause the oscillations caused by the two springs 44*a* and 60*a* to be greater, but in addition to this the initial impact by the spring 21 raising the shaker 25 a substantial distance and then having it abruptly stop by making contact with the upper stop member 40 would cause a much greater impact, and thus a greater sound.

As another option in the present invention, the tuned frequency of the spring mass system could be modified in either of two ways (or possibly by combination of the two). With reference to the first embodiment, this could be accomplished by removing the upper stop member 40 and also the shaker member 25 and replacing the spring 44 with a stronger or weaker spring. Also, instead (or in addition to) replacing the spring, another shaker could be positioned in the mechanism, with the shaker having a different mass. Also, as indicated above, both of these could be done.

The same method could be used in modifying the second embodiment by replacing either or both of the springs and/or replacing the shaker with one of different mass.

The range of the shaker 25 (or referred to as the "first range") is defined as the path of travel of the shaker in operation. This range is the path of travel between the rotor overhang 46 and the second portion 49 of the spring 44. In the preferred form, the shaker 25 oscillates in the vertical direction. However, it can be appreciated that the longitudinal axis of the rod member 14 can be aligned in the substantially vertical direction.

It is to be recognized that various modifications and additions could be made to the design present invention and the mode of operation without departing from the basic teachings thereof.

I claim:

1. An apparatus to create musical noise comprising:

a shaker having an inner surface defining a central cavity where a plurality of impact particles are contained therein, a central base portion having a lower surface and an upper surface a frame member having a first base support surface and a second support surface a first spring member having a lower portion and an upper portion where the lower portion is supported by said first base support surface of the said frame member, a drive rod having a lower portion, a central portion and an upper portion, and comprising a lower stop member positioned below the second support surface of the frame member, the drive rod further comprising:

an intermediate stop member having a lower surface and an upper surface;

an upper stop member having a lower stop surface a second spring interposed between the upper surface of the intermediate stop member and the lower surface of the central base portion of the shaker so that the second spring is adapted to apply a vertical force to the shaker;

whereby, the central base portion of the shaker is slidably connected to the said drive rod and is interposed between the second spring member and the lower stop surface of the upper stop member.

2. The apparatus in claim 1 further comprising:

a foot pedal attached to the lower portion of the drive rod whereas the foot pedal is adapted to display the drive rod vertically downward and compress the said first spring.

3. The apparatus as recited in claim 1 where the second spring is positioned vertically above the first spring and the frame member.

4. The apparatus as recited in claim 1 where the shaker is torus shaped.

5. The apparatus as recited in claim 1 where the frame member comprises a cylinder and the drive rod is adapted to extend therethrough.

6. The apparatus as recited in claim 5 where the first base support surface of the frame member is an annularly inward extending flange of the frame member.

7. The apparatus as recited in claim 6 where the second base support surface of the frame member is an annularly inward extending flange of the frame member located in the upper portion of the frame member.

8. The apparatus as recited in claim 1 where intermediate stop member comprises a nut member which is adapted to be threaded to the drive rod.

9. The apparatus as recited in claim 1 wherein, the lower stop surface of the stop member comprises a cushioning material.

10. A method of creating a musical noise comprising the steps of:

providing a shaker having an inner surface defining a cavity containing a plurality of impact particles that are loosely positioned therein to create a rattling noise when impacting the said inner surface, slidably positioning the said shaker on a first member between a stop member having an impact surface and a shaker spring having first and second engaging portions, where the first engaging portion of the shaker spring is operatively engaged to the first member and the second engaging portion engages the shaker, displacing the first member in a manner that when the first member is displaced in a first direction, the impact surface of the stop member applies force to the shaker, thereby causing an acceleration of the shaker in the first direction, decelerating the first member thereby causing the shaker to compress the shaker spring, the shaker spring accelerates the shaker in a second direction, the shaker impacts the impact surface of the stop member thereby decelerating the shaker traveling in the second direction;

whereby, the impact particles loosely positioned in the said cavity of the shaker are adapted to create a musical noise based upon the accelerations of the shaker in the said first and second direction.

11. The method as recited in claim 10 where the shaker travels in a substantially reciprocating motion.

12. The method as recited in claim 11 where there is a sufficiently high rate of acceleration and/or deceleration of the shaker so that the impact particles become positioned above a resting position of the impact particles and hence as the impact particles fall on the lower portion of the inner surface of the shaker, a downward force is exerted thereon and the shaker spring has a compression force exerted thereon.

13. The method as recited in claim 12 wherein said compression force causes an oscillating movement of the shaker.

14. The method as recited in claim 3 where the first member is displaced a second time to supply a force upon the shaker to continue the oscillations of the shaker.

15. The method as recited in claim 10 where the first and second directions are substantially vertically downwardly and substantially vertically upwardly respectively.

16. The method as recited in claim 10 wherein there is further provided a base spring which is operatively engaged to the first member and arranged so that when the first member travels in the said first direction the base spring compresses and the base spring exerts an accelerating force on the first member in the said second direction.

17. The method as recited in claim 16 wherein there is a frame member which is stationary with respect to movement of the first member.

18. The method as recited in claim 10 where the first and second directions are diametrically opposed to one another.

19. The method as recited in claim 10 further comprising the steps of supplying a foot pedal connected to the said first member and depressing and releasing the foot pedal to cause movement of the first member.

20. An apparatus to create musical noise comprising:

a) a first member having a longitudinal axis with the first member being arranged to travel in a substantially reciprocating motion along the said longitudinal axis the first member comprising:

i) a first stop location engaging a first portion of a shaker spring and the shaker spring having a second portion at a second location spaced from the first portion, ii) a second stop location located on the first member at a distance from the first stop location, b) a shaker having an inner surface defining a cavity that is adapted to hold a plurality of impact particles, c) the shaker being arranged to be moved in the direction of the longitudinal axis and at least a portion of the shaker being arranged to move between the second stop location and the second portion of the said shaker spring.

21. The apparatus as recited in claim 20 wherein the shaker is positioned on the first member to move into and out of contact with an impact surface of the second stop location.

22. The apparatus as recited in claim 21 wherein the shaker is arranged to have a rest position where at least a portion of the shaker is in contact with the said impact surface of the second stop location and the said shaker spring is arranged to bias the shaker toward the impact surface.

23. The apparatus as recited in claim 22 wherein there is a base spring which is operatively engaged to the first member to urge the first member in the second direction.

24. The apparatus as recited in claim 23 wherein the apparatus is arranged so that when the shaker moves in the first direction by a force caused by the impact surface at the second stop location to cause an acceleration of the first member in the first direction, the base spring is compressed to provide a restraining force.

25. The apparatus as recited in claim 20 where the longitudinal axis has a first direction and a second direction, and the impact surface of the second stop location is arranged to bias the shaker toward said first direction and there is a base spring arranged to bias the shaker toward the second direction.

26. The apparatus as recited in claim 25 further comprising a frame member having a first portion of the base spring operatively engaged thereto and a second portion of the base spring is operatively engaged to the said first member to bias the said first member toward said second direction.

27. The apparatus as recited in claim 26 further comprising a foot pedal adapted to displacing the said first member in the said first direction.

28. The apparatus in claim 26 wherein the first stop location is arranged to engage an impact surface of the frame member whereby there is a decelerating of the first member when the first member is completing travel in the said first direction.

29. The apparatus as recited in 28 where the frame member further comprises a foot pedal connected thereto that is arranged to displace the first member in the first direction.

30. The apparatus as recited in claim 29 whereas said frame member is oriented so that the first direction is substantially vertically downward.

31. The apparatus as recited in claim 30 wherein the frame member is arranged so that the second direction is substantially vertically upward.

* * * * *